US006571433B2

(12) United States Patent
Uehara et al.

(10) Patent No.: US 6,571,433 B2
(45) Date of Patent: Jun. 3, 2003

(54) BUCKLE

(75) Inventors: Ryoichiro Uehara, Toyama-ken (JP); Hiroshi Matoba, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/963,703

(22) Filed: Sep. 27, 2001

(65) Prior Publication Data

US 2002/0040515 A1 Apr. 11, 2002

(30) Foreign Application Priority Data

Sep. 28, 2000 (JP) ..... 2000-296050

(51) Int. Cl.[7] ..... A44B 11/25

(52) U.S. Cl. ..... 24/614; 24/621; 24/625; 24/648; 24/679

(58) Field of Search ..... 24/614, 648, 657, 24/621, 679, 625, 666

(56) References Cited

U.S. PATENT DOCUMENTS 4,398,324 A * 8/1983 Bakker et al. ..... 24/625
4,577,377 A * 3/1986 Kasai ..... 24/625
4,639,982 A * 2/1987 Kasai ..... 24/625
4,672,725 A * 6/1987 Kasai ..... 24/625
4,987,661 A * 1/1991 Kasai ..... 24/625
5,291,641 A * 3/1994 Morino ..... 24/625
5,465,472 A * 11/1995 Matoba ..... 24/614
5,941,337 A * 8/1999 Castellanos et al. ..... 24/614
6,061,883 A * 5/2000 Uehara ..... 24/625
6,311,374 B1 * 11/2001 Anscher ..... 24/614

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

A buckle is composed of a buckle body and an insertion body. The buckle includes an engagement and disengagement system in which the insertion body is inserted into the buckle body. An elastic member provided with elasticity, which is made of, for example, natural rubber, synthetic rubber or thermoplastic elastomer, is integrally molded on a pressing surface formed on an operating portion for performing an engagement and disengagement operation of the buckle by bicolor molding means or insert molding means. The pressing surface of the operating portion may be disposed on the buckle body or may be disposed on the insertion body. In either case, it is possible to produce a buckle having a good touch. Consequently, since the operating portion is flexible and soft to the touch, a smooth engagement and disengagement operation of the buckle can be realized.

11 Claims, 16 Drawing Sheets

BUCKLE

BACKGROUND OF THE INVENTION

1. Field of the Invention

The present invention relates to a buckle having an engagement and disengagement system in which a male member, namely, an insertion body is inserted in a female member, namely, a buckle body. Particularly, the present invention relates to a buckle for fastening a belt that is generally used for clothes, a bag, a helmet, a baby buggy, sporting goods or the like.

2. Description of the Related Art

FIG. 25 shows a conventional buckle with an engagement and disengagement system in which a pair of insertion legs 21' of an insertion body 2' are inserted in a housing 8' of a buckle body 1' thereof, which is disclosed in Japanese Design Registration Publication No. 984098. In the buckle, roughened surfaces having uneven faces 5*a*' are formed on outside surfaces of the insertion legs 21' so that the insertion legs 21' of the insertion body 2' can be easily handled in operation.

Furthermore, FIG. 26 shows another conventional buckle of an engagement and disengagement system in which a pair of insertion legs 21" of an insertion body 2" is inserted in a housing 8" of a buckle body 1" thereof, which is disclosed in Japanese Patent Application Laid-Open No. 8-299030. In this buckle, openings 51" for operation are formed by cutting out opposite sides of the housing 8" of the buckle body 1", while operating portions 4", from which the openings 51" are adapted to appear, are provided on outsides of the insertion legs 21" of the insertion body 2". The above-mentioned openings 51" of the housing 8" are covered by a ring-shaped elastic member such as an elastomer, a rubber or the like to form a covered portion 52". The engaged insertion legs 21" are pressed from the outside of the covered portion 52" so that the engagement can be released.

In the above described buckle shown in FIG. 25, pressing surfaces 5' of the insertion legs 21" of the insertion body 2' are merely formed to be uneven faces 5*a*'. Therefore, this buckle is rigid, harsh to the touch and does not have flexibility. Further, the buckle shown in FIG. 26 involves such a problem that it requires many steps to be manufactured so that the manufacturing cost thereof becomes high.

SUMMARY OF THE INVENTION

The present invention has been made taking the foregoing problems into consideration. A main object of the present invention is to provide a buckle with an engagement and disengagement system which has flexible operating portions that are good to the touch so that a smooth engagement and disengagement operation can be realized, which is provided with a soft touch and further which is capable of being manufactured very simply at a low cost.

Furthermore, in addition to the above object of the prevent invention, an object of the present invention is to provide a buckle in which pressing surfaces provided with elastic members for performing the engagement and disengagement operation thereof are respectively formed on a pair of the insertion legs of an insertion body of the buckle, so that the operation of the buckle becomes easy Still further, in addition to the above object of the prevent invention, an object of the present invention is to provide a buckle in which the pressing surfaces of the elastic members formed on the insertion body are formed so as not to be void of sliding contact with the buckle body, so that abrasion of the elastic members is prevented.

Still further, in addition to the above object of the prevent invention, an object of the present invention is to provide a buckle in which pressing surfaces provided with elastic members for performing the engagement and disengagement operation thereof are formed on side levers disposed at opposite sides of the buckle body or formed on a pressing plate disposed at an upper side thereof, so that the operation of this buckle becomes easy.

Still further, in addition to the above object of the prevent invention, an object of the present invention is to provide a buckle with an engagement and disengagement system in which materials of the buckle body, the insertion body and the elastic member provided on the operating portion are specified so as to bring out an excellent function of a buckle with a good quality.

Still further, in addition to the above object of the prevent invention, an object of the present invention is to provide a colorful buckle with an engagement and disengagement system in which a color of the buckle body and the insertion body is made to be different from a color of the elastic members provided on the operating portions.

Still further, in addition to the above object of the prevent invention, an object of the present invention is to provide a buckle with an engagement and disengagement system in which the touch of the operating portions for performing the engagement and disengagement operation is made to be better and more reliable.

Still further, in addition to the above object of the prevent invention, an object of the present invention is to provide a buckle with an engagement and disengagement system which is produced by means that can simply mold the buckle body, the insertion body and the elastic members so as to have an excellent function and that can mold a colorful buckle.

Still further, in addition to the above object of the prevent invention, an object of the present invention is to provide a buckle with an engagement and disengagement system in which the elastic members are disposed not only on the insertion legs of the insertion body but also on a surface of the buckle body so that the buckle is easily grasped, and the engagement and disengagement operation can be accurately and smoothly performed.

Still further, in addition to the above object of the prevent invention, an object of the present invention is to provide a buckle with an engagement and disengagement system in which the elastic member arranged on a pressing plate formed at the upper side of the buckle body or on the surface of the buckle body is utilized to display a pattern or a logo mark, which is part of the buckle body and whose color is different from that of the elastic member, on a part of the elastic member, so that expansion of sales of the buckle can be expected.

In order to attain the above described objects, according to the present invention, there is provided a buckle of an engagement and disengagement system comprising a buckle body and an insertion body in which the insertion body is inserted into the buckle body. In this buckle, a pressing surface, which is formed on an operating portion for performing an engagement and disengagement operation, may be disposed on the buckle body or may be disposed on the insertion body. An elastic member provided with elasticity is integrally disposed on the pressing surface formed on the operating portion.

Therefore, the pressing surface of the operating portion is flexible and soft to the touch so that it is possible to develop a quality of the buckle and the smooth engagement and disengagement operation is capable of being performed.

Furthermore, according to the present invention, it is preferable that the pressing surface formed on the operating portion for performing the engagement and disengagement operation is formed on an outside surface of each of a pair of insertion legs, which are provided on the insertion body.

Still further, according to the present invention, it is preferable that the pressing surface of the operating portion for performing the engagement and disengagement operation, which is formed on the outside surface of each of the pair of insertion legs of the insertion body, is not formed so as not to be in sliding contact with the buckle body.

Still further, according to the present invention, it is preferable that the pressing surface formed on the operating portion for performing the engagement and disengagement operation is formed on an outside surface of each of side levers, which are provided at opposite sides of the buckle body.

Still further, according to the present invention, it is preferable that the pressing surface formed on the operating portion for performing the engagement and disengagement operation is formed on a surface of a pressing plate, which is disposed at an upper side of the buckle body.

Therefore, the pressing surface of the operating portion, which is provided with the elastic member 6, has a simple structure, so that the buckle is capable of being appropriately and easily applied to buckles with the engagement and disengagement system of various types in common use.

Still further, according to the present invention, it is preferable that the buckle body and the insertion body are molded of thermoplastic resin as material thereof, the elastic member disposed on the pressing surface of the operating portion is made of natural rubber, synthetic rubber or thermoplastic elastomer.

Therefore, a good quality buckle can be produced by effectively using a material, which is ordinarily used, as a material of the buckle.

Still further, according to the present invention, it is preferable that a color of the buckle body and the insertion body is made to be different from a color of the elastic member provided on the pressing surface of the operating portion.

Therefore, it is possible to easily produce a colorful and beautiful buckle, which can be expected to expand sales of the buckle.

Still further, according to the present invention, it is preferable that the elastic member disposed on the pressing surface of the operating portion, which is provided on the buckle body and the insertion body, is projected more than a surface of the operating portion.

Therefore, it is possible to produce a good buckle in which the touch and the feel of the operating portion for performing the engagement and disengagement operation is more excellent.

Still further, according to the present invention, it is preferable that the buckle body or the insertion body and the elastic member disposed on the pressing surface of the operating portion are integrally molded by bicolor molding means or insert molding means.

Therefore, it is possible to mold the buckle body or the insertion body and the elastic member by easily using such molding means in common use, so that a good quality and low-priced buckle is capable of being produced.

Still further, according to the present invention, it is preferable that the elastic member is disposed on the pressing surface of the operating portion of the insertion body or on the pressing surface of the operating portion of the buckle body, and the elastic member is further disposed on a part of the surface of the buckle body.

Therefore, it is possible to easily grasp the housing of the buckle and to smoothly perform the engagement and disengagement operation.

Still further, according to the present invention, it is preferable that a pattern or a logo mark, which is part of the buckle body having a color different from the elastic member, is displayed on part of the elastic member, which is disposed on the pressing plate formed on the surface of the buckle body or which is disposed on the surface of the buckle body.

Therefore, it is possible to effectively use the buckle body and the elastic member and easily display a pattern and a log mark on the buckle, so that the sales expansion of the buckle can be expected.

As a result, the effects of the present invention are very prominent.

DESCRIPTION OF EMBODIMENTS

Figure 1:
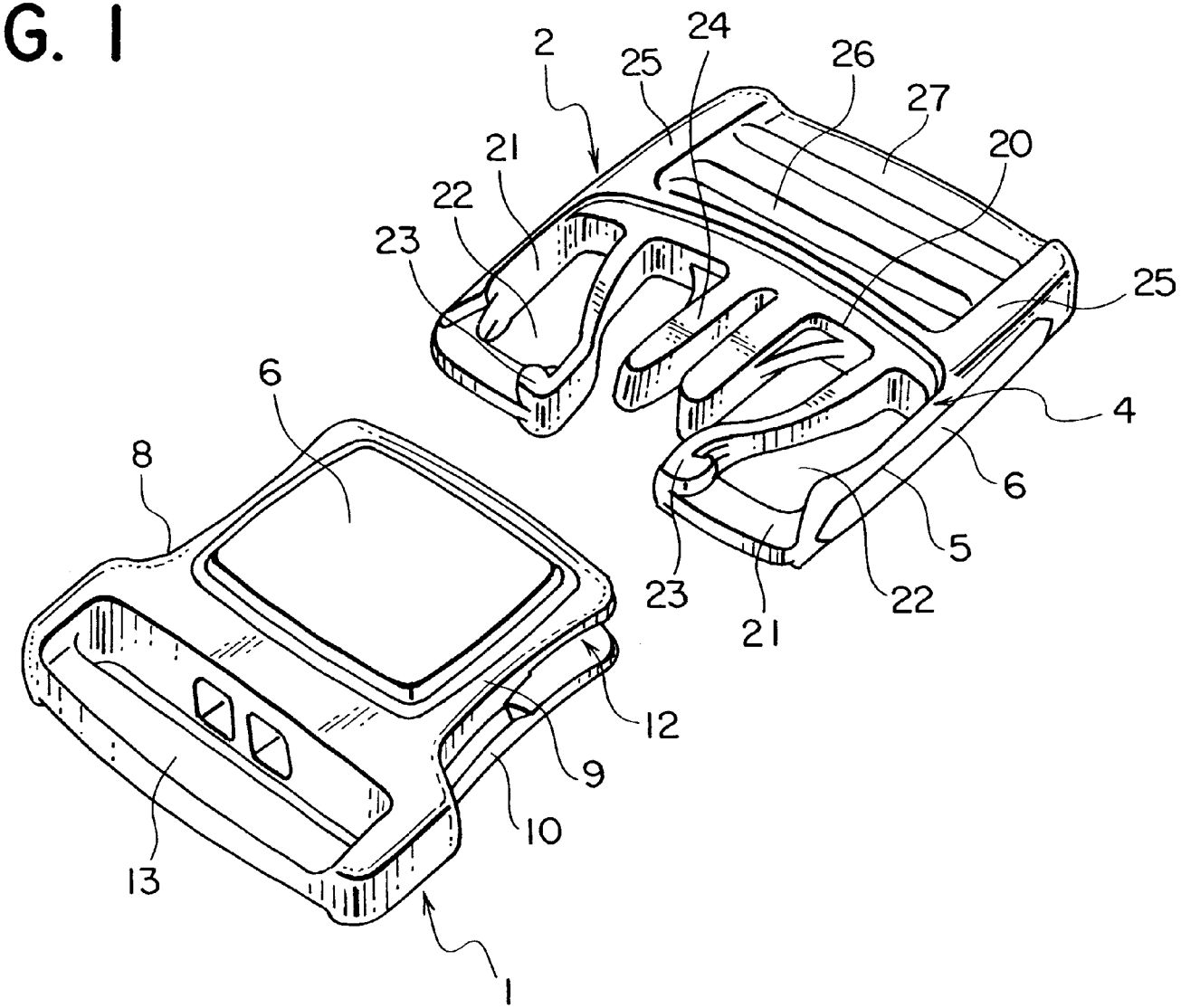
FIG. 1 is a perspective view of a buckle according to a first embodiment of the present invention showing a state that a buckle body and an insertion body are separated.
Figure 2:
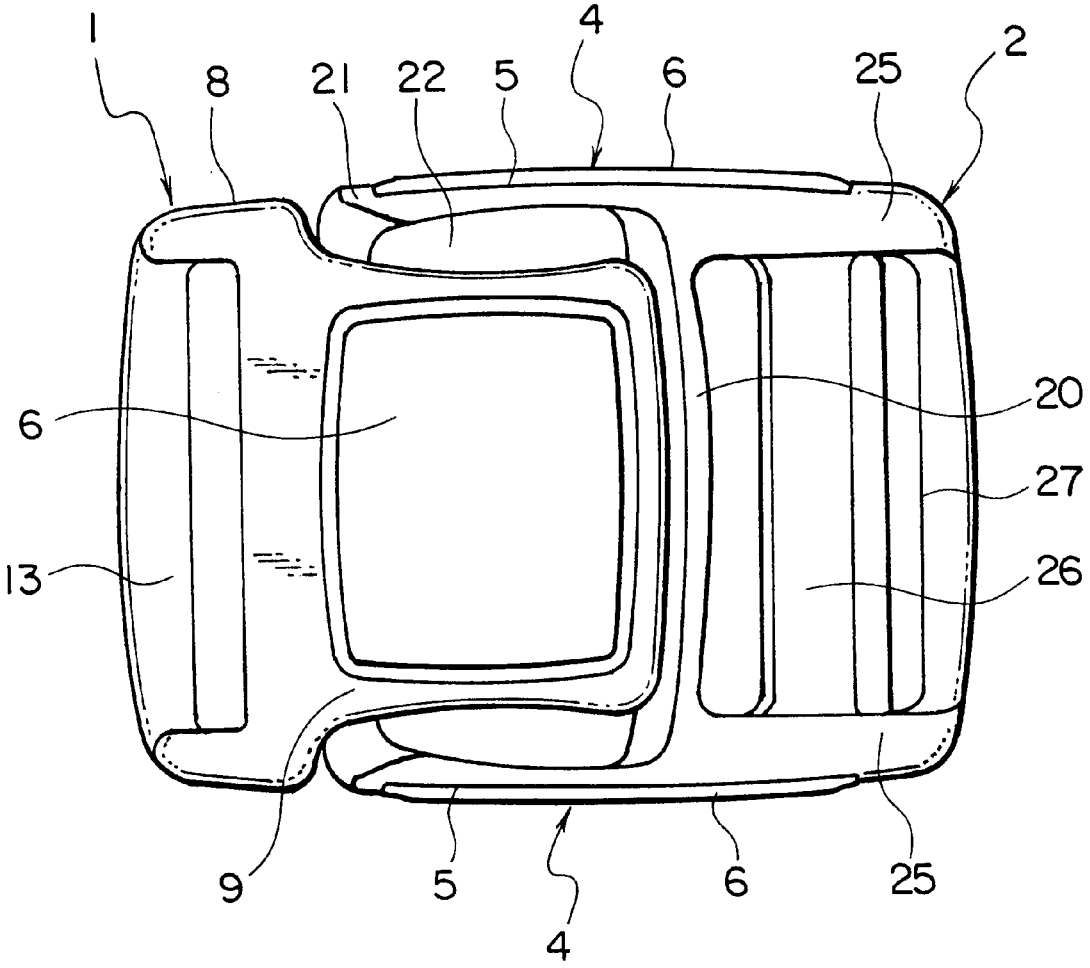
FIG. 2 is a front view showing a state that the insertion body is inserted in the buckle body according to the first embodiment.
Figure 3:
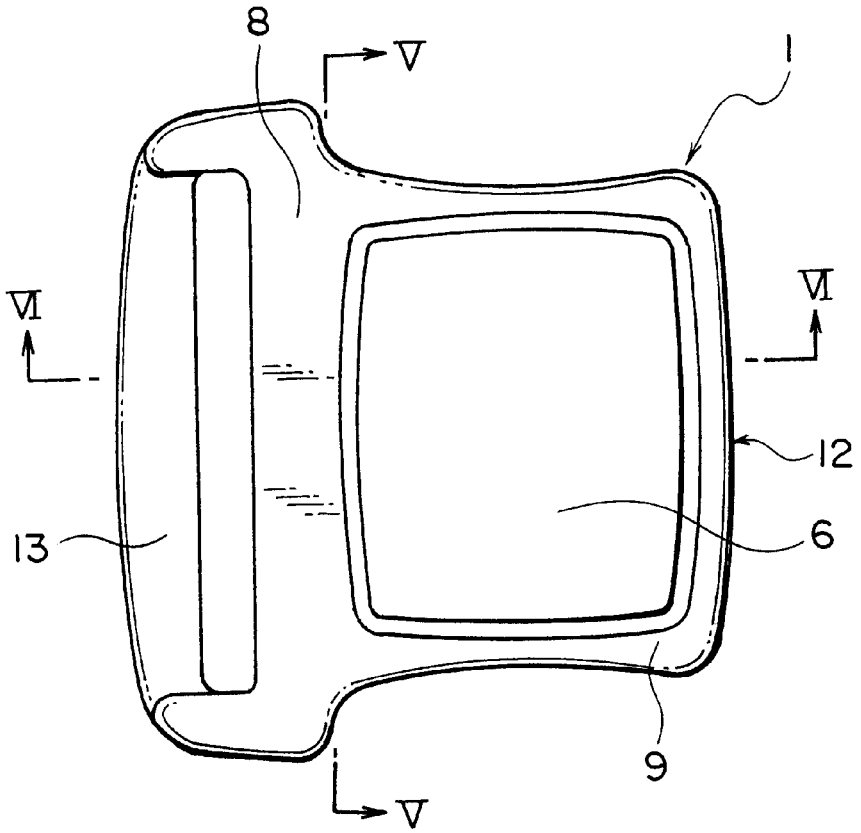
FIG. 3 is a front view of the buckle body of the buckle according to the first embodiment.

Embodiments of the present invention will be specifically described below with reference to the drawings.

A buckle according to the present invention is characterized in that it is a buckle with an engagement and disengagement system, which is composed of a buckle body 1 referred to as a socket and an insertion body 2 referred to as a plug capable of being inserted in the buckle body 1. The buckle is further provided with elastic members 6, which have elasticity, on pressing surfaces 5 of operating portions 4 for performing the engagement and disengagement operation of the insertion body 2 with the buckle body 1.

Figure 4:
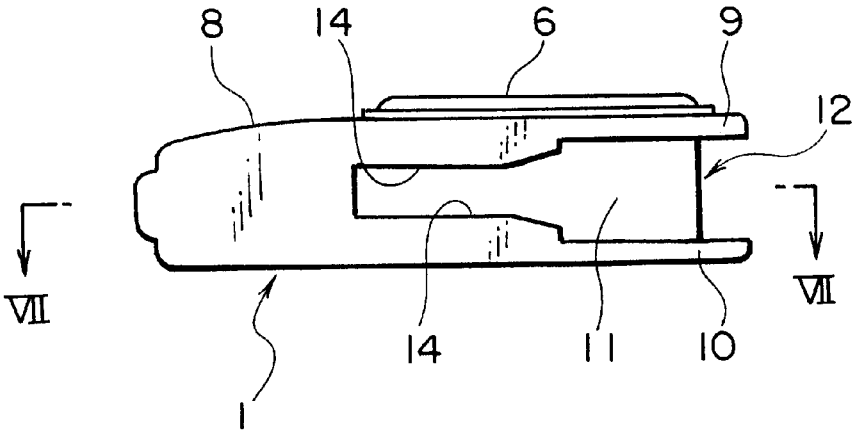
FIG. 4 is a side view of the buckle body of the buckle according to the first embodiment.
Figure 7:
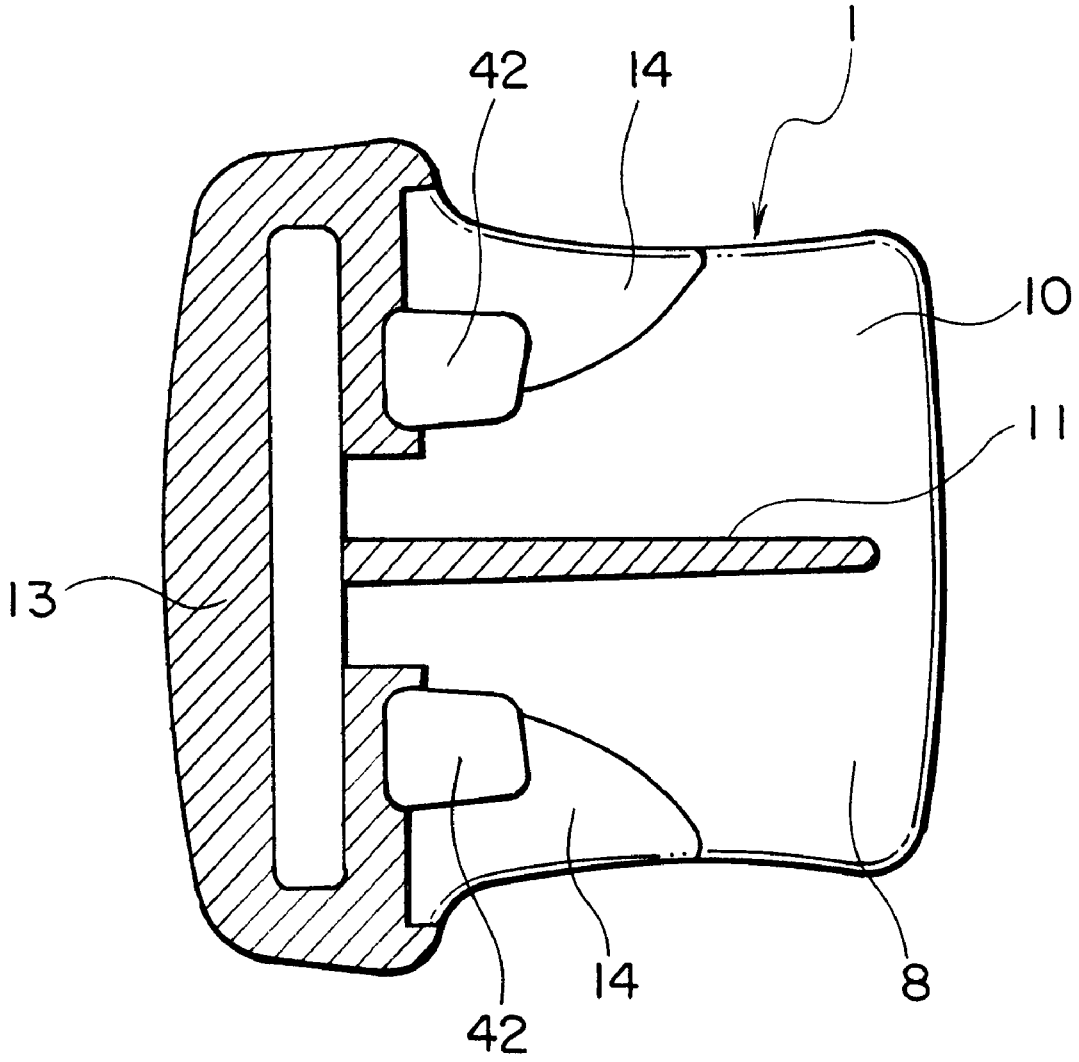
FIG. 7 is a cross-sectional view of the buckle taken along a VII—VII line of FIG. 4.
Figure 8:
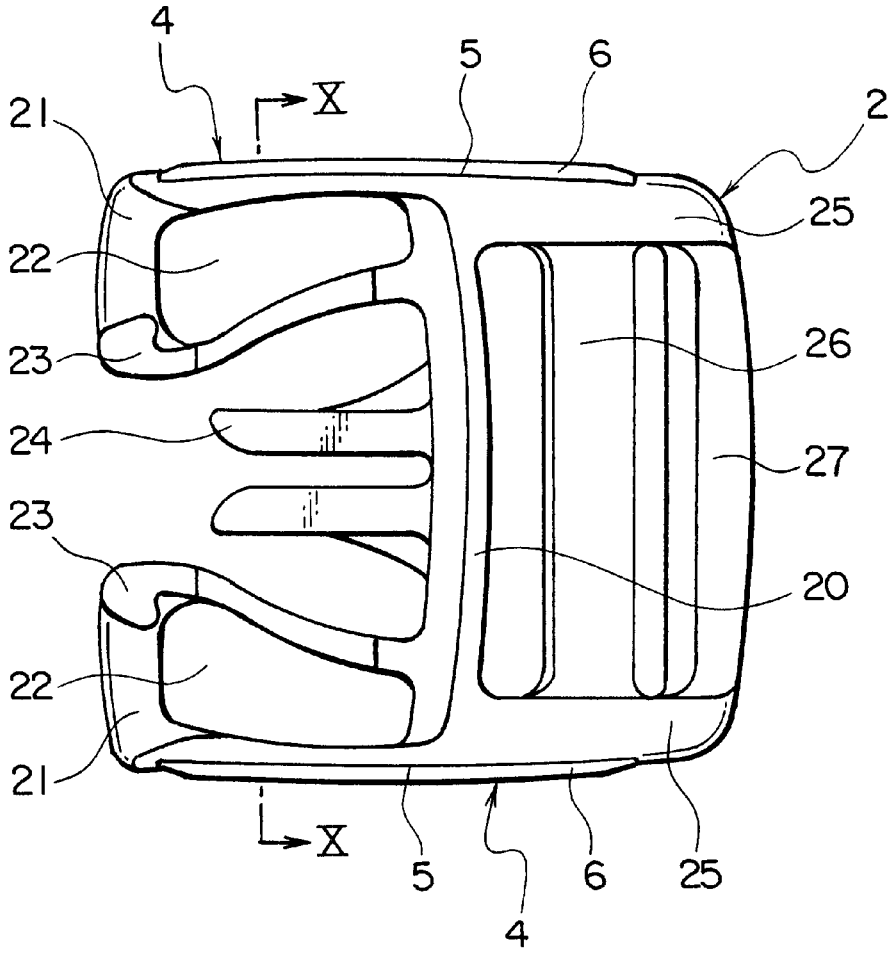
FIG. 8 is a front view of the insertion body of the buckle according to the first embodiment.
Figure 9:
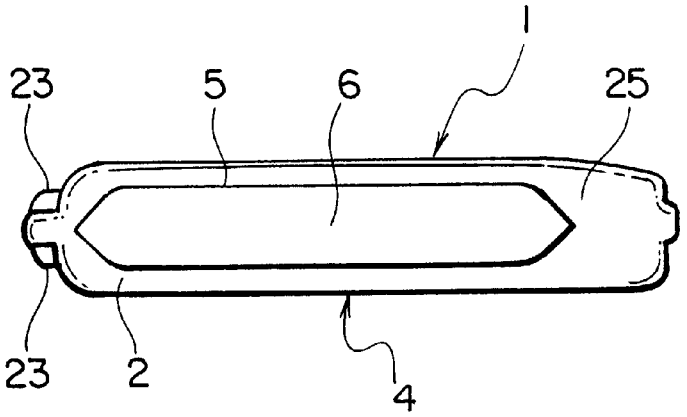
FIG. 9 is a side view of the insertion body of the buckle according to the first embodiment.
Figure 10:
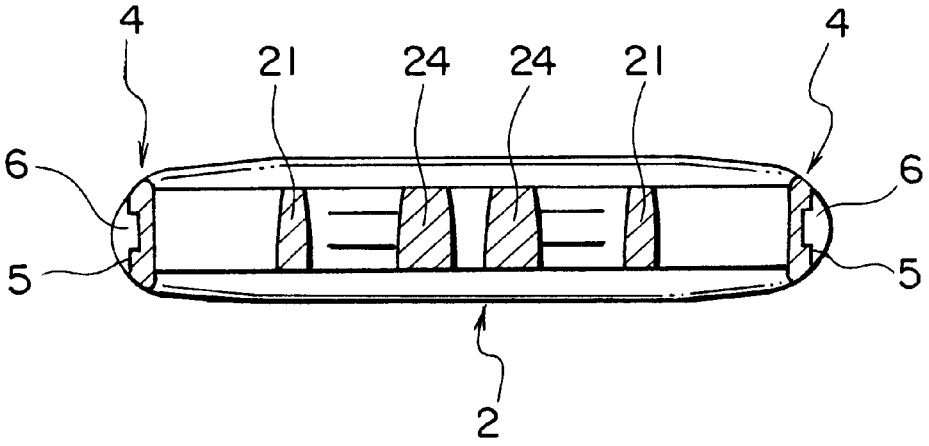
FIG. 10 is a cross-sectional view of the buckle taken along a X—X line of FIG. 8.

A buckle according to a first embodiment of the present invention, which are shown in FIGS. 1 to 10, will be described below. The buckle body 1 is formed with a flat housing 8. As shown in FIGS. 4 and 7, the housing 8 is formed of a top plate 9 and a bottom plate 10 that are connected to each other with a middle partition 11 arranged at a center of the top plate 9 and the bottom plate 10 in a longitudinal direction thereof. The housing 8 is opened at three sides, namely, a front end and opposite sides thereof. Further, an insertion opening 12 is provided at one end of the housing 8 so that the insertion body 2 is capable of being inserted therein, while a belt attaching portion 13 is provided at the other end thereof so that the belt is capable of being attached thereto. Engaging portions 14, which are inwardly protruded and capable of being engaged with engaging protrusions 23 of the insertion body 2, are formed at inner opposite sides of the top plate 9 and the bottom plate 10. An elastic member 6 provided with elasticity is arranged on a front surface of the top plate 9 by bicolor molding means or insert molding means. Therefore, the housing 8 provided with the elastic member 6 can be easily grasped so that the engagement and the disengagement operation can be easily performed when the insertion body 2 is inserted into the buckle body 1.

The insertion body 2 is formed with insertion legs 21, which protrude forward, at opposite sides of a base bar 20 of the insertion body 2. Each of the insertion legs 21 is formed with a longitudinal hole portion 22 which is defined in a center thereof so that the insertion legs 21 can be elastically deformed in a plain direction thereof. Further, the engaging protrusions 23 capable of being engaged with the engaging portions 14 are provided on both top and bottom surfaces of inner sides of front ends of the insertion legs 21. A pair of projections 24 are projected at a center of the base bar 20 so as to be engaged with the middle partition 11, which is provided in the housing 8. Side frames 25, which are extended from the insertion legs 21, are provided on the opposite sides of the base bar 20. A hooking member 26 for hitching a belt and a fastening member 27 capable of fastening the belt are formed between the side frames 25, in order that a length of the belt is adjusted.

Operation portions 4, which are capable of performing the engagement and disengagement operation for insertion of the insertion body 2 into the buckle body 1, are formed on outside surfaces of the insertion legs 21 and the side frames 25 of the insertion body 2. The elastic members 6, which are provided with elasticity, are integrally disposed on the pressing surfaces 5 of the operating portions 4 so as to project more than the pressing surfaces 5. By the elastic members 6 with elasticity being arranged on the pressing surfaces 5 of the operating portions 4, the pressing surfaces 5 become flexible and soft to the touch, so that it is possible to smoothly perform the engagement and disengagement operation when the engagement and disengagement operation for insertion of the insertion body 2 into the buckle body 1 is performed. Furthermore, the pressing surfaces 5 of the operating portions 4, which are disposed on the outside surfaces of the insertion legs 21, only move forward and backward on the outside of the opposite sides of the housing 8 when being inserted into the housing 8 of the buckle body 1. Therefore, it does neither wear away nor damage the elastic members 6 which are arranged on the pressing surfaces 5.

The buckle body 1 and the insertion body 2 are made of thermoplastic resin such as polyamide, a polyacetale, polypropylene and a polybutylene-terephthalate or the like, or a mixture of these resins with abrasive-resistant reinforcing agent and are molded by injection molding means. Alternatively, the elastic member 6 disposed on the pressing surface 5 of the operating portion 4 may be made of natural rubber, synthetic rubber or polyethylene-terephthalate, polyamide and polyurethane elastomer. In this case, the elastic member 6 is integrally molded together with the buckle body 1 or the insertion body 2 by bicolor molding means or insert molding means upon molding the buckle body 1 or the insertion body 2. Further, the color of the buckle body 1 and the insertion body 2 may be made to be different from the color of the elastic members 6. For example, the buckle body 1 and the insertion body 2 may be colored in yellow while the elastic members 6 are colored in black, so that a colorful and beautiful buckle can be produced. Besides that, it is possible to produce a buckle having various patterns and logo marks being displayed thereon by directly and partially exposing the buckle body 1 or the insertion body 2 on a part of the elastic members 6.

Figure 5:
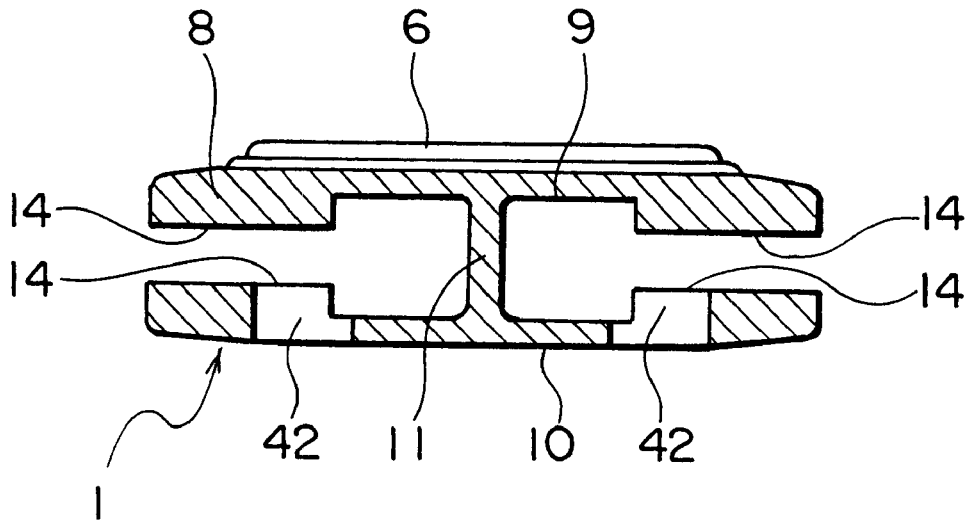
FIG. 5 is a cross-sectional view of the buckle taken along a V—V line of FIG. 3.
Figure 6:
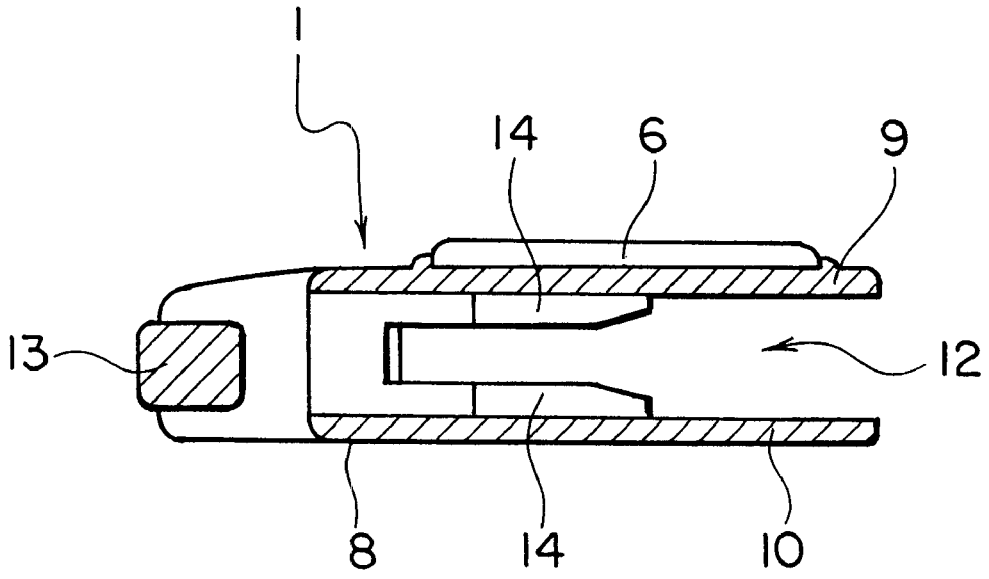
FIG. 6 is a cross-sectional view of the buckle taken along a VI—VI line of FIG. 3.

In FIGS. 5 and 7, a reference numeral 42 denotes a hole portion for a core for the purpose of molding each of the engaging portions 14 to be provided on each of inside surfaces of the top plate 9 and the bottom plate 10 of the housing 8. In FIGS. 5 and 7, the hole portions for cores 42 are provided on the bottom plate 10.

According to a buckle of a second embodiment, which is shown in FIGS. 11 to 15, side levers 16 are provided at opposite sides of the housing 8 of the buckle body 1 as operating portions 4 to perform the engagement and disengagement operation of the insertion body 2. Elastic members 6 provided with elasticity are arranged on pressing surfaces 5 of the side levers 16. The buckle body 1 is formed with a flat housing 8 composed of a top plate 9, a bottom plate 10 and side walls 15. A middle partition 11 is provided at a center of the top plate 9 and the bottom plate 10 in a longitudinal direction thereof. The side levers 16, of which base portions are connected to the buckle body 1 and which are capable of being freely elastically deformed, are extended from side walls 15 at a side of an insertion opening 12 to a front end. Projections 17, which project inward, are provided on front ends of these side levers 16 so that the projections 17 can press insertion legs 21 of an insertion body 2. Further, engaging portions 14 are interposed between the top plate 9 and the bottom plate 10 in the vicinity of the front ends of the projections 17 so that the engaging portions 14 can be engaged with engaging protrusions 23 of the insertion legs 21 of the insertion body 2. Further, it is possible that the insertion legs 21 are inserted between the engaging portions 14 and the middle partition 11.

Figure 12:
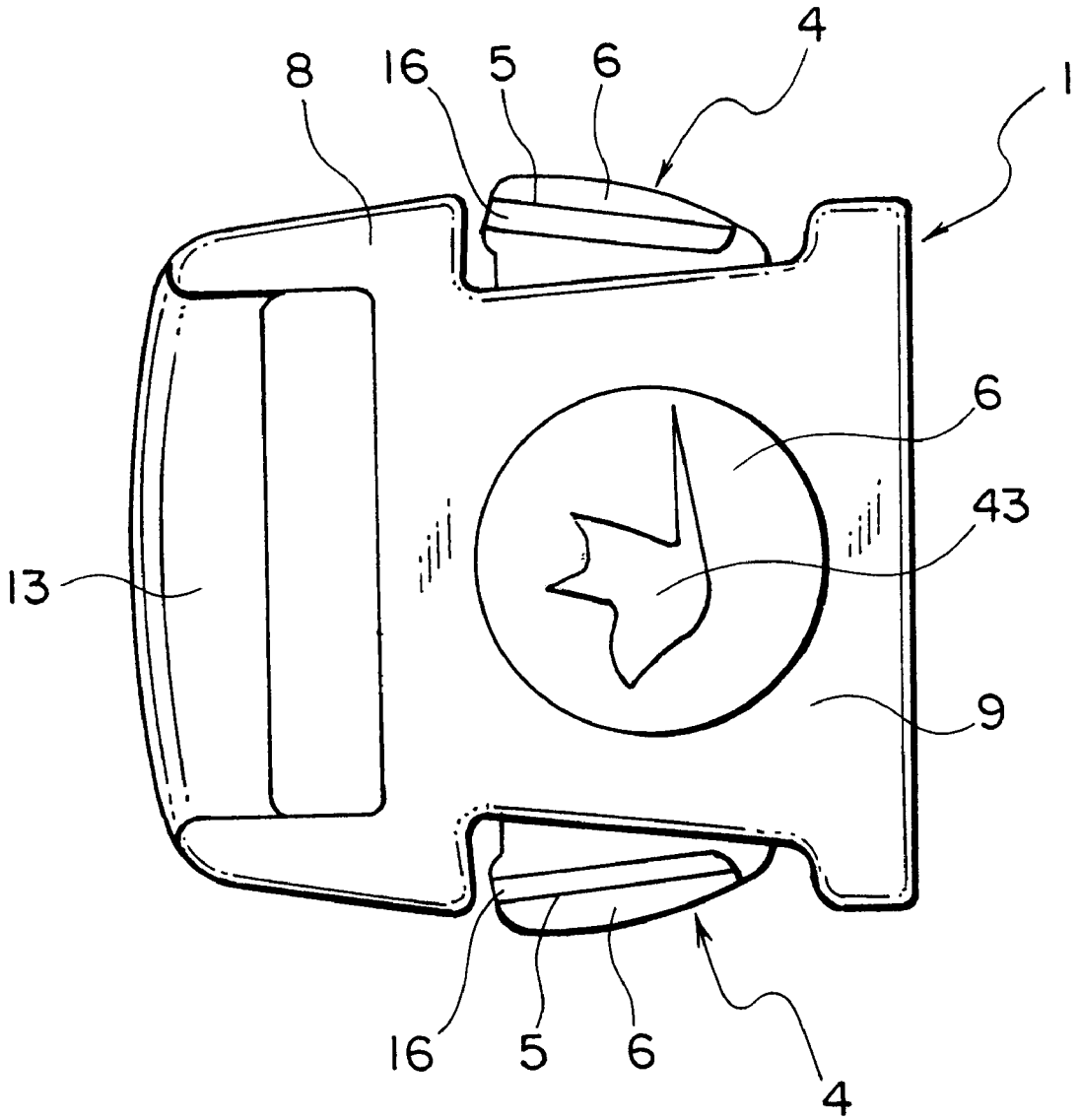
FIG. 12 is a front view of the buckle body of the buckle according to the second embodiment.
Figure 13:
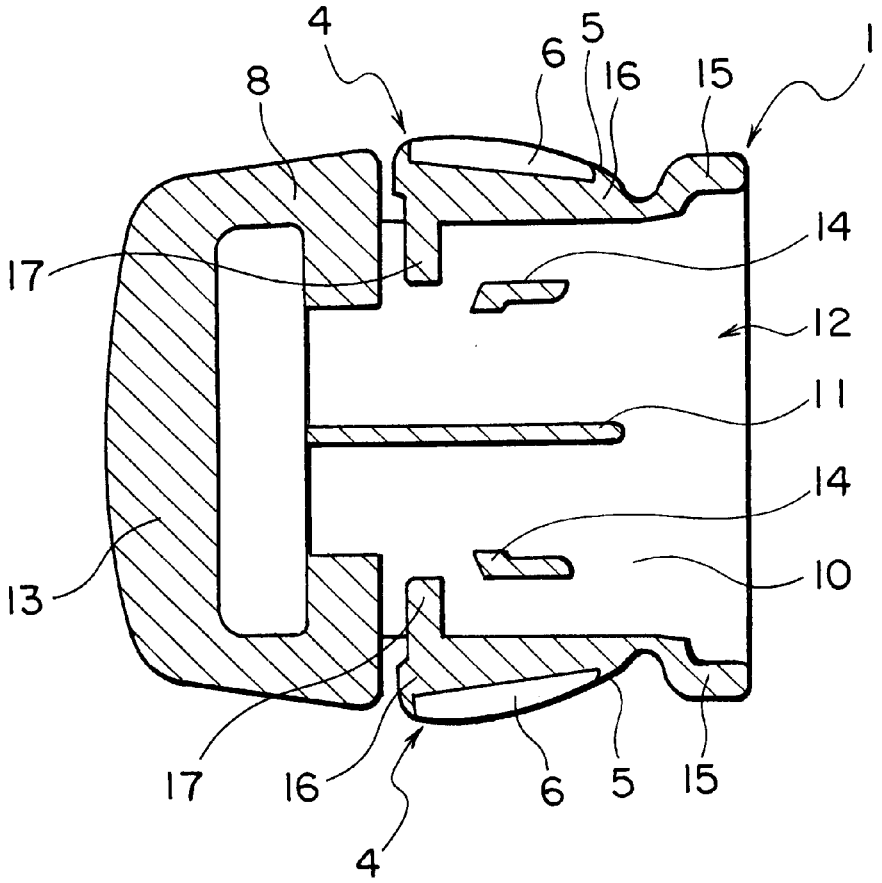
FIG. 13 is a cross-sectional view of the buckle taken along a XIII—XIII line of FIG. 14.
Figure 14:
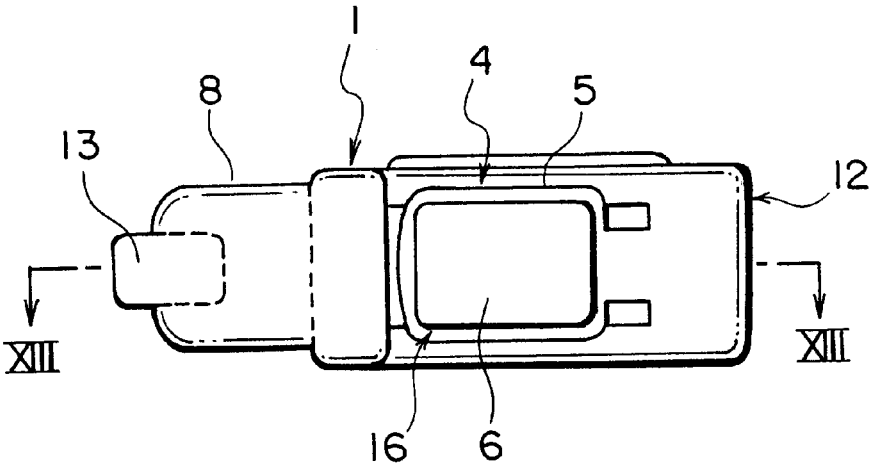
FIG. 14 is a side view of the buckle body of the buckle according to the second embodiment.

As shown in FIG. 12, in the housing 8, the elastic members 6 provided with elasticity are integrally molded on the pressing surfaces 5 of the side levers 16 such that they project from the pressing surfaces 5 by the bicolor means or the insert molding means. Further, an elastic member 6 is integrally molded on a surface of the top plate 9 so as to project from the top plate 9. The disengagement operation is performed by pressing down the side levers 16 with one hand of a user. On the other hand, the engaging operation is performed by holding the top plate 9 and the bottom plate 10 of the housing 8 with one hand and inserting the insertion body 2 into the housing 8 with the other hand. In this case, the elastic member 6 on the top plate 9 is soft to the touch as the elastic members 6 on the side levers 16, so that the smooth operation can be performed. In addition, as shown in FIG. 12, a material of the buckle body 1 partially appears on a portion of the elastic member 6 on the top plate 9 so as to display a pattern 43, so that it is possible to form a colorful buckle body 1.

Figure 15:
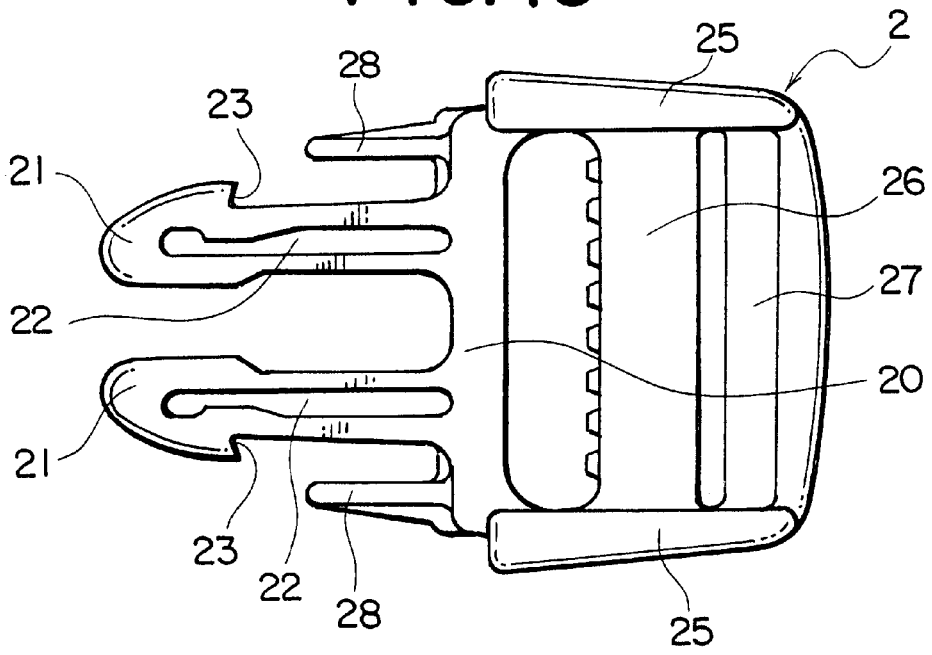
FIG. 15 is a front view of the insertion body of the buckle according to the second embodiment.
Figure 16:
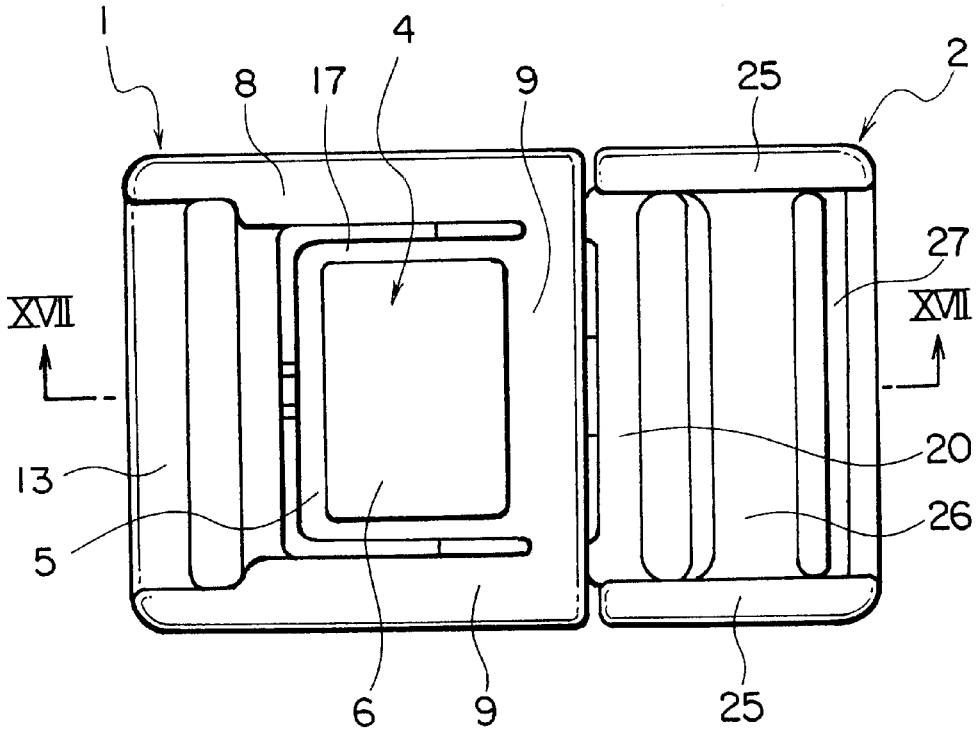
FIG. 16 is a front view of a buckle according to a third embodiment of the present invention showing a state that an insertion body is inserted in a buckle body.
Figure 17:
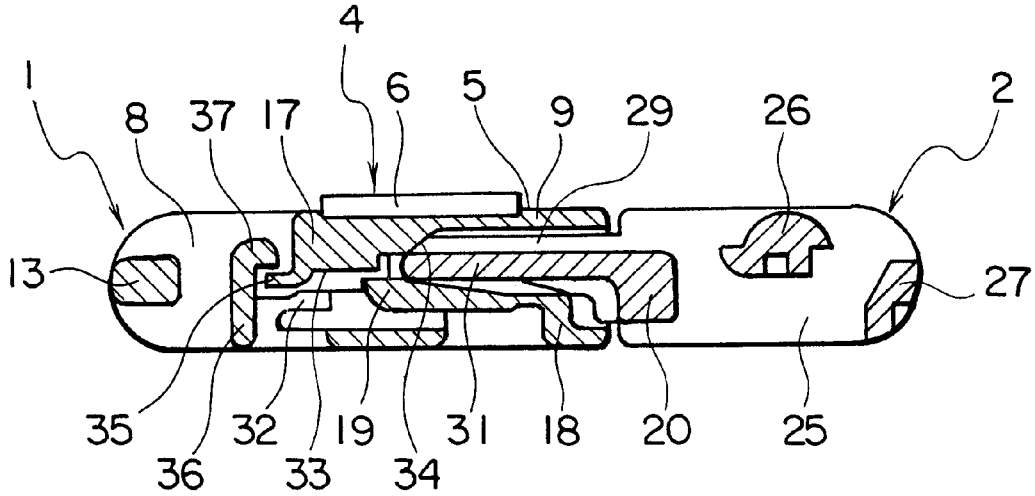
FIG. 17 is a cross-sectional view of the buckle taken along a XVII—XVII line of FIG. 16.

As shown in FIG. 15, the insertion body 2 is formed with guide members 28 at opposite ends of a base bar 20 so as to project therefrom. When the insertion legs 21 are inserted into the housing 8, the guide members 28 guide the insertion legs 21 and prevent oscillation of the insertion legs 21. Furthermore, a pair of the insertion legs 21 are projected on a front surface of the base bar 20. Each of the insertion legs 21 is provided with elasticity by providing a longitudinal hole portion 22 at a center thereof, and an engaging protrusion 23 in a hook shape is formed at an outside of the insertion leg 21, so that the insertion legs 21 are engaged with the engaging portions 14 of the housing 8. Side frames 25 are provided at opposite sides of the other ends of the base bar 20. A hooking member 26 for hitching a belt thereon and a fastening member 27 capable of fastening the belt are formed between the side frames 25, so that a length of the belt can be adjusted. In Addition, similar to the first embodiment, it is also possible to arrange an elastic members 6 on the outside surfaces of the side frames 25.

Figure 11:
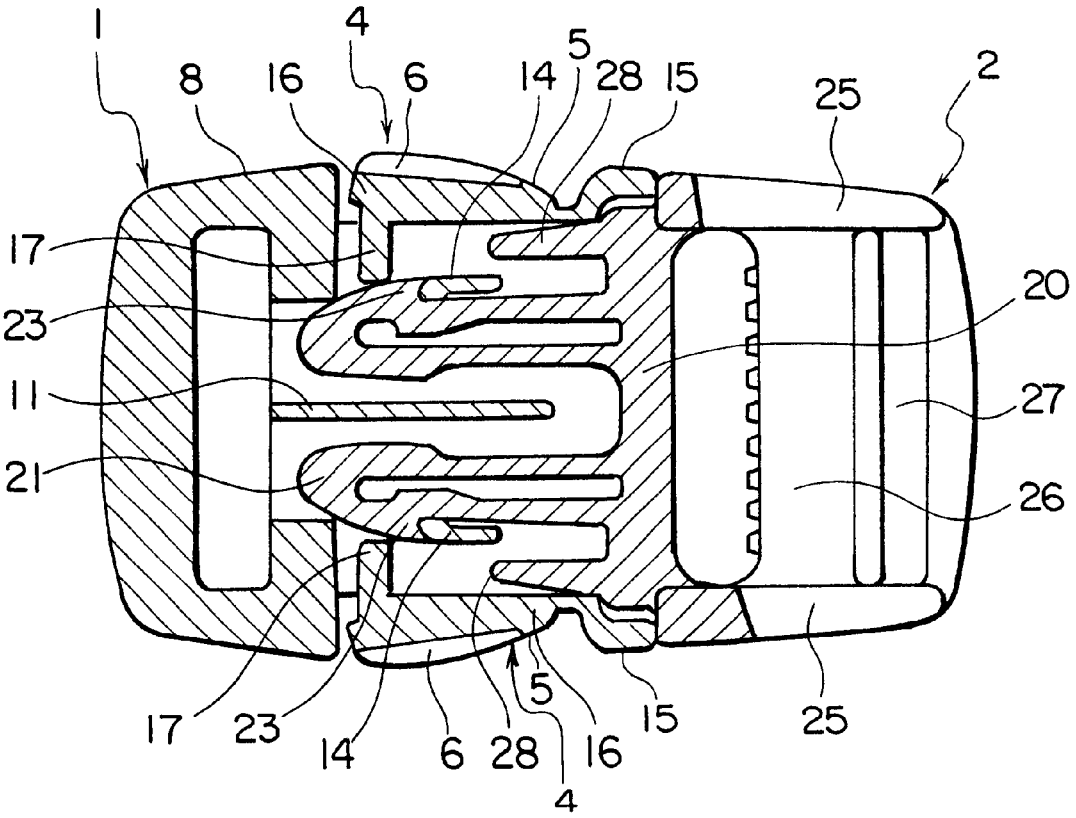
FIG. 11 is a partially broken front view of a buckle according to a second embodiment of the present invention showing a state that an insertion body is inserted in a buckle body.

In order to release the engagement of the buckle body 1 and the insertion body 2 to separate them, as shown in FIG. 11, the pressing surfaces 5 of the side levers 16 on which the elastic members 6 are arranged are pressed, so that the engagement of the engaging portions 14 and the engaging protrusions 23 is released. As a result, by pulling away the insertion legs 21 from the housing 8, the insertion legs 21 can be separated from the housing 8.

Figure 18:
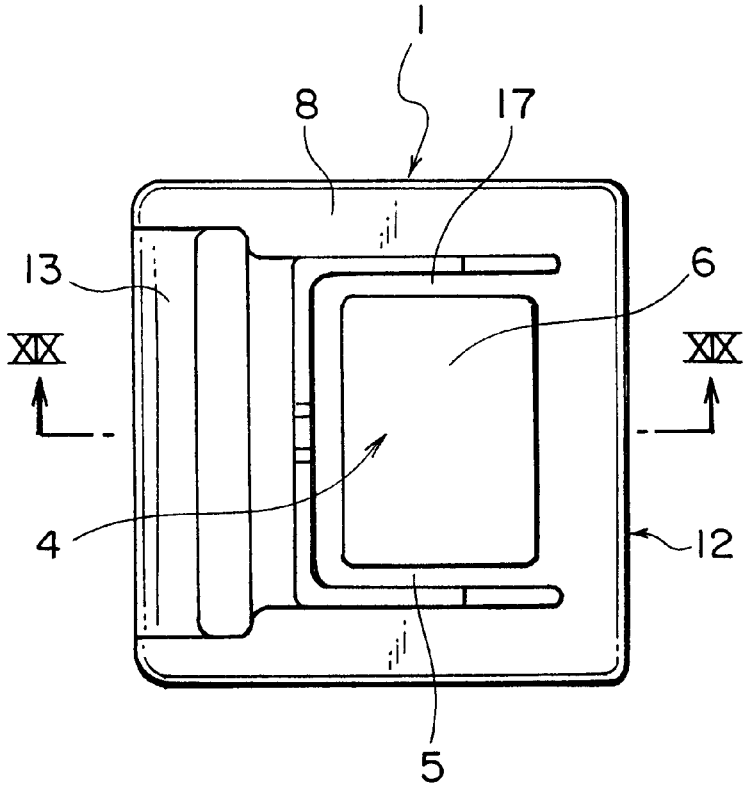
FIG. 18 is a front view of the buckle body of the buckle according to the third embodiment.
Figure 19:
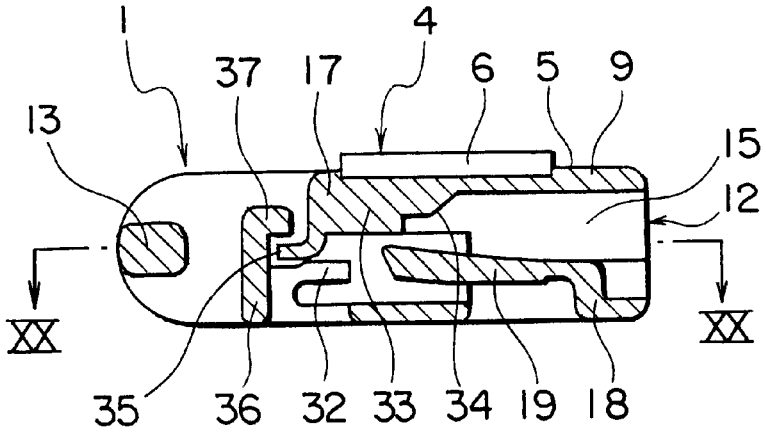
FIG. 19 is a cross-sectional view of the buckle taken along a XIX—XIX line of FIG. 18.
Figure 20:
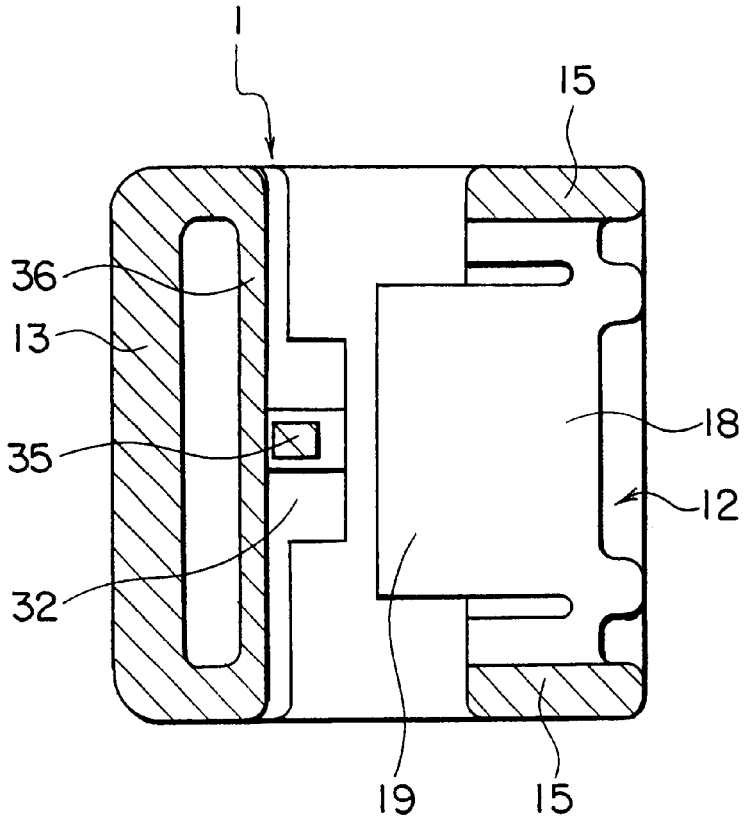
FIG. 20 is a cross-sectional view of the buckle taken along a XX—XX line of FIG. 19.

According to a buckle of a third embodiment of the present invention shown in FIGS. 16 to 22, there is provided a pressing plate 17, which serves as an operating portion 4 for performing the engagement and disengagement operation of an insertion body 2, on a top plate 9 of a housing 8 of a buckle body 1. An elastic member 6 provided with elasticity is disposed on a pressing surface 5 of the pressing plate 17. The buckle is composed of the buckle body 1 and the insertion body 2. As shown in FIGS. 18 to 20, the buckle body 1 is provided with an insertion opening 12 at one end of a housing 8, into which an insertion plate 29 of the insertion body 2 is capable of being inserted. The top plate 9 is cut with slitters at three sides thereof except a side of the insertion opening 12, so that the pressing plate 17 is formed in a tongue shape having flexibility. The pressing surface 5 is formed on a surface of this pressing plate 17, and the elastic member 6 is integrally molded to be mounted on the pressing surface 5 so as to project from the pressing surface 5 by the bicolor molding means or the insert molding means.

Figure 21:
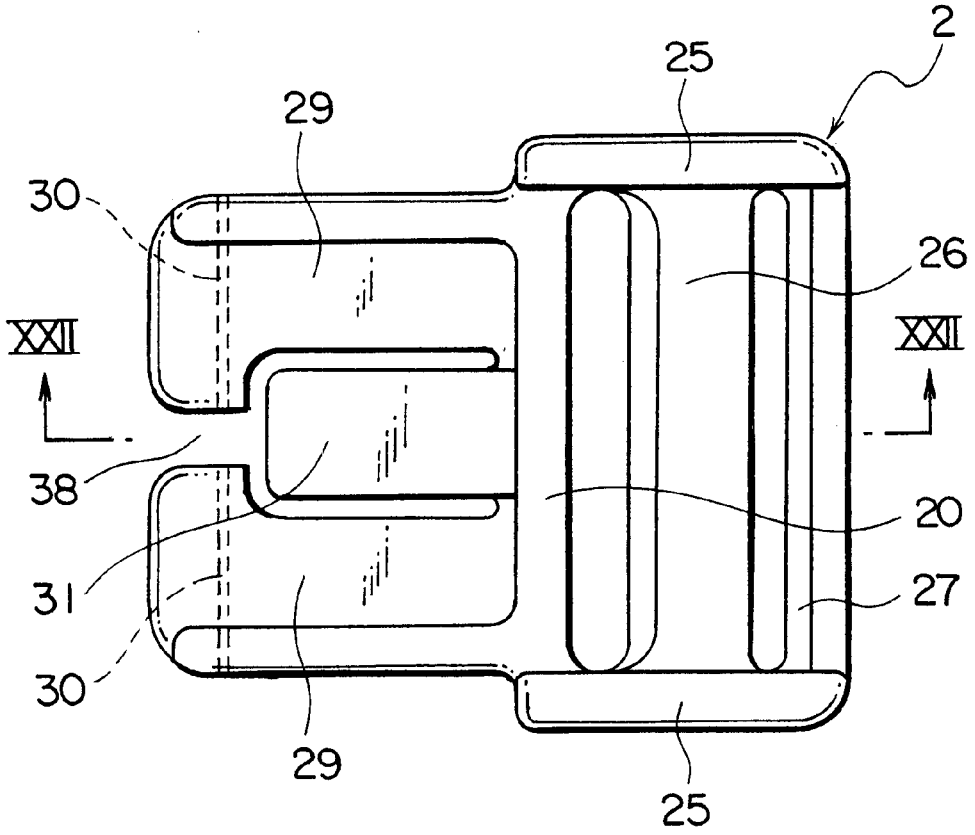
FIG. 21 is a front view of the insertion body of the buckle according to the third embodiment.
Figure 22:
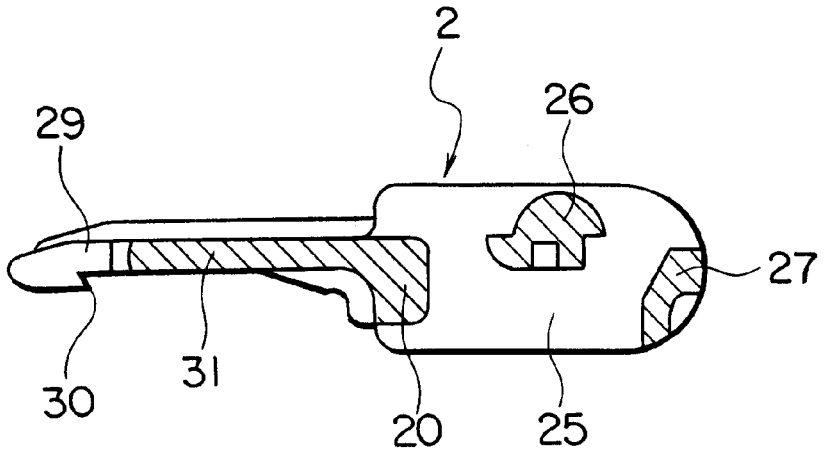
FIG. 22 is a cross-sectional view of the buckle taken along an XXII—XXII line of FIG. 21.

The insertion opening 12 is formed between the top plate 9 and a base table 18 formed between opposite side walls 15 of the housing 8. An engaging piece 19 in a tongue shape having flexibility is projected extending from the base table 18 in an insertion direction of the insertion body 2. A front end of the engaging piece 19 is formed so as to be projected slightly upward. As shown in FIGS. 21 and 22, the insertion body 2 has an insertion plate 29, which is flat and projected on a front surface of a base bar 20 thereof. An elastic tongue portion 31 in a tongue shape having flexibility is provided on a center portion of this insertion plate 29 with three sides except for a side of the base bar 20 being cut. The engaging piece 19 is provided with a receiving portion 32, which is provided at a lower portion so as to be engaged with a locking pawl 30 provided on the insertion plate 29 of the insertion body 2. When the insertion plate 29 is inserted ahead of the engaging piece 19, the receiving portion 32 can receive a front end of the insertion plate 29.

The pressing plate 17 is provided with a pressing projection 33 projected on a center of a rear surface of the pressing plate 17 in order to release the engagement of the engaging piece 19 and the locking pawl 30 of the insertion plate 29 by being pressed down when the insertion plate 29 of the insertion body 2 is inserted in the buckle body 1. When this pressing projection 33 presses down the pressing plate 17, the front end of the engaging piece 19 is pressed down so as to release the insertion plate 29 from the locking pawl 30. Further, the pressing plate 17 is provided with an inclined portion 34 at a middle portion between the pressing projection 33 and a non-projection portion thereof. When the insertion plate 29 is inserted in the buckle body 1, the inclined portion 34 elastically deforms the elastic tongue portion 31 of the insertion plate 29 so that the locking pawl 30 is engaged with the engaging piece 19. Further, when the engagement of the engaging piece 19 and the locking pawl 30 of the insertion plate 29 is released by the pressing down of the pressing projection 33, the elastic tongue portion 31 force the insertion plate 29 to move along the inclined portion 34, so that it is possible to expel the insertion plate 29 from the housing 8. A small tongue portion 35 in a hook shape is projected on a lower front end of the pressing projection 33 to be engaged with a hook portion 37, which is formed at an upper portion of a rear wall 36 formed between the side walls 15 of the housing 8, so that upward oscillation of the pressing plate 17 is regulated.

Further, the elastic tongue portion 31 of the insertion body 2 is formed so as to elastically abut with the inclined portion 34 of the pressing plate 17 of the buckle body 1. The insertion plate 29 ahead of the elastic tongue portion 31 is separated at a center thereof so as to be divided into right and left parts, so that a cut-out portion 38 is formed. The cut-out portion 38 is formed so as to avoid the pressing projection 33 of the pressing plate 17 when the insertion body 2 is inserted in the buckle body 1. The locking pawl 30 in a hook shape is provided on a lower surface of the front end of this insertion plate 29 so as to be engaged with the engaging piece 19 of the buckle body 1.

Tall side frames 25 are connected to the opposite sides of the base bar 20. Between the side frames 25, there is provided a hooking member 26 for hooking a belt and a fastening member 27 capable of fastening the belt so that a length of the belt is adjusted. In addition, according to the present embodiment, it is also possible to arrange an elastic member 6 on outside surfaces of the side frames 25 similarly to the first embodiment.

For releasing the engaged buckle to be separated into the buckle body 1 and the insertion body 2, the pressing surface 5 having the elastic member 6 thereon, of the pressing plate 17, which is provided on the housing 8 of the buckle body 1, is pushed down to press down the pressing projection 33 through the cut-out portion 38 of the insertion plate 29 and press down the front end of the engaging piece 19. Consequently, the insertion plate 29 is supported by the receiving portion 32 to release the engaging piece 19 from the locking pawl 30, and at the same time, the elastic tongue portion 31 of the insertion plate 29 is forced back by the inclined portion 34, so that the insertion plate 29 is separated and released from the housing 8.

Figure 23:
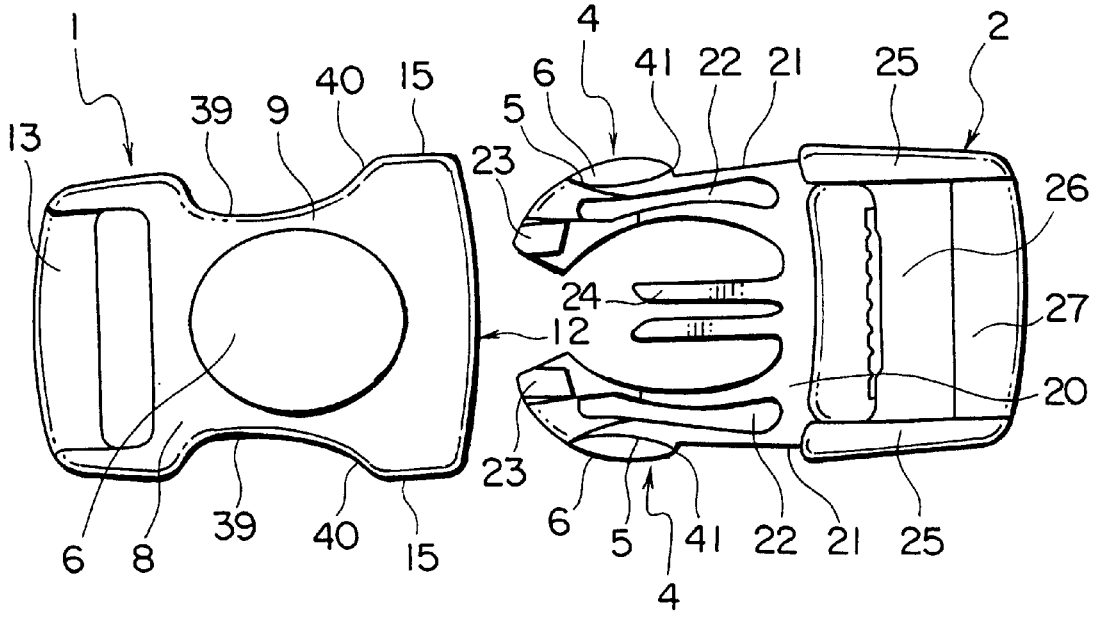
FIG. 23 is a front view of a buckle according to a fourth embodiment of the present invention showing a state that an insertion body and a buckle body are separated.
Figure 24:
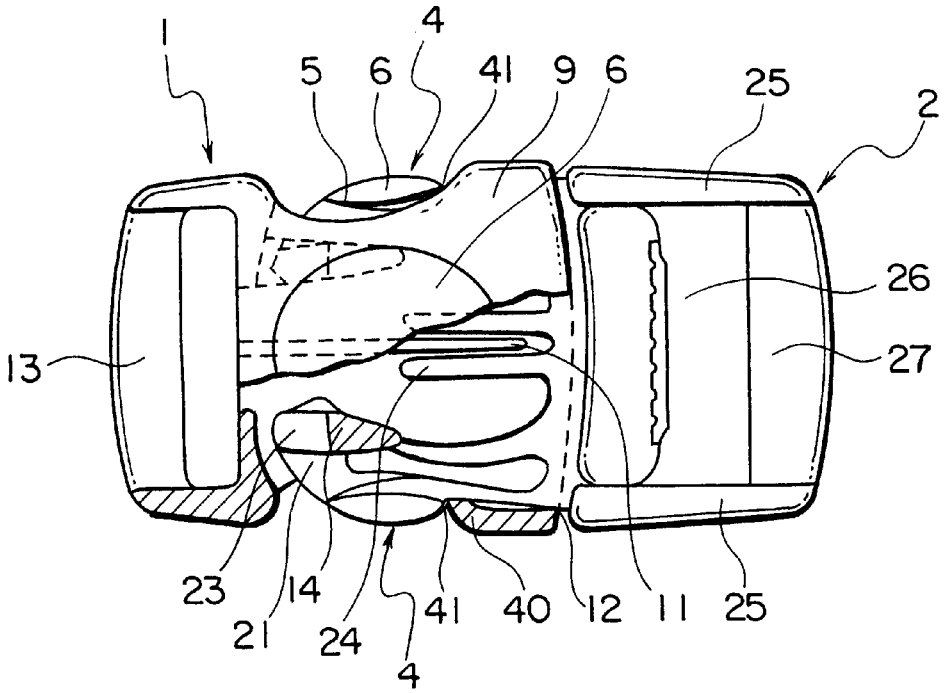
FIG. 24 is a front view showing a state that the insertion body is inserted in the buckle body of the buckle according to the fourth embodiment.
Figure 25:
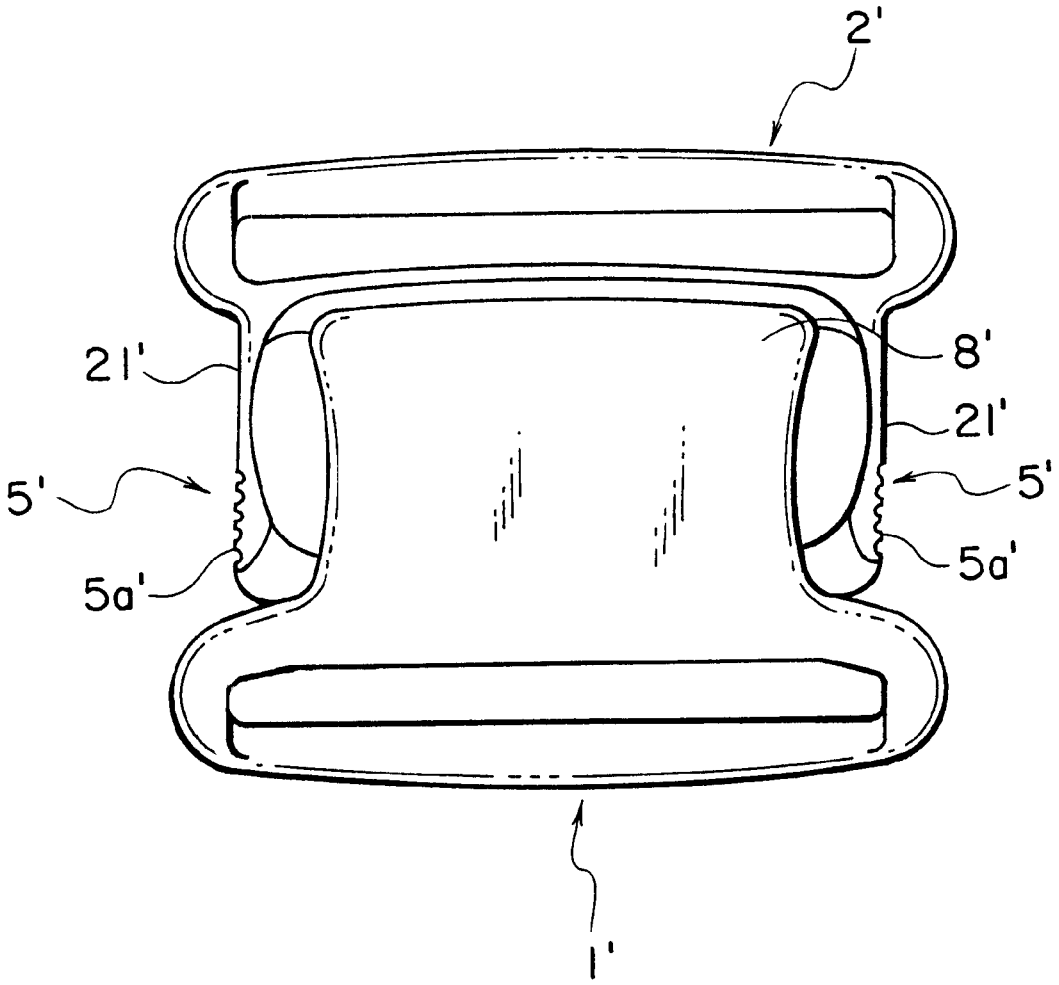
FIG. 25 PRIOR ART
FIG. 25 is a front view of a known buckle.
Figure 26:
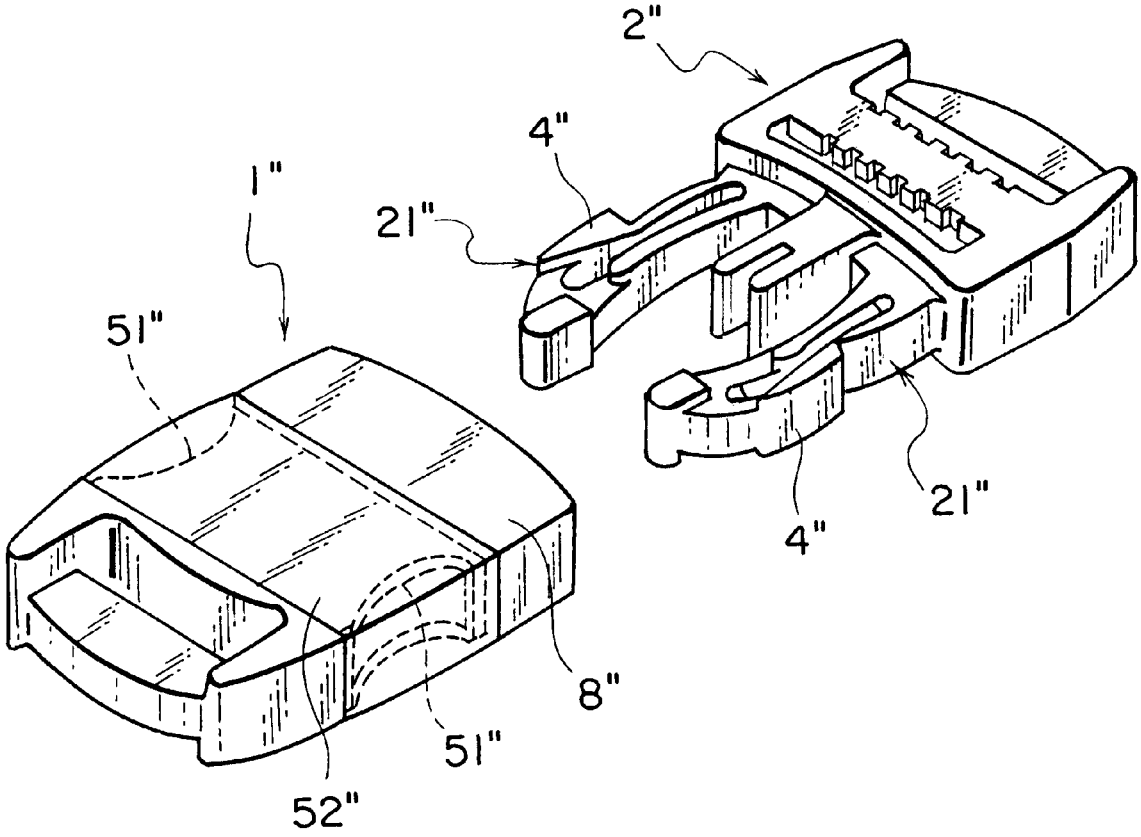
FIG. 26 PRIOR ART
FIG. 26 is a front view of another known buckle.

A buckle according to a fourth embodiment, which is shown in FIGS. 23 and 24, is composed of a buckle body 1 and an insertion body 2. The buckle body 1 is formed with a housing 8 in a flat shape comprising a top plate 9, a bottom plate 10 and side walls 15. The buckle body 1 is formed with an insertion opening 12 at one end thereof and a belt attaching portion 13 at the other end thereof. The side walls 15 are cut out in arc shapes to form openings 39. The openings 39 are formed such that pressing surfaces 5 of operating portions 4, which are formed on insertion legs 21 of the insertion body 2 for performing the engagement and disengagement operation with respect to the buckle body 1, can appear out of the openings 39 Further, a second engaging portion 40 is provided on each of the side walls 15 on the side of the insertion opening 12 of the openings 39 so as to be engaged with a second connecting protrusion 41, which is formed on each of insertion legs 21 of the insertion body 2.

A middle partition 11 to connect the top plate 9 with the bottom plate 10 is provided a center of the housing 8 in a longitudinal direction thereof. The middle partition 11 is formed such that the insertion legs 21 of the insertion body 2 can be fit on opposite sides of the middle partition 11. First engaging portions 14 are provided on inner surfaces of the top plate 9 and the bottom plate 10 at an inner side of the openings 39 so as to project inwardly, so that the first engaging portions 14 can be engaged with engaging protrusions 23 which are formed at front ends of the insertion legs 21 of the insertion body 2. An elastic member 6, which may be of any shape, is integrally molded on a surface of the housing 8, namely, a surface of the top plate 9 by bicolor molding means or insert molding means. Consequently, the housing 8 having a soft touch can be formed.

The insertion body 2 is formed with a pair of the insertion legs 21 projected on front opposite sides of a base bar 20. Each of the insertion legs 21 is formed with a center longitudinal hole portion 22, so that the insertion legs 21 are capable of being elastically deformed in a plane direction thereof. Further, operating portions 4, which bulge to the outside, are provided at centers of outside surfaces of the insertion legs 21. The elastic members 6 are integrally molded on pressing surfaces 5 of the operating portions 4 by the bicolor means or the insert molding means. The elastic members 6 are molded on the pressing surfaces 5 contact the side walls 15 of the insertion opening 12 when the insertion body 2 is inserted in the housing 8. Therefore, it is preferable that recessed portions, which are capable of receiving the elastic members 6, are provided on the pressing surfaces 5 for filling the elastic members 6 in the recessed portions to keep the outlines in order to prevent abrasion.

The insertion legs 21 of the insertion body 2 are shaped to be slightly curved to the inside. Further, the insertion legs 21 are formed with the engaging protrusions 23, which are capable of engaging with the first engaging portions 14 provided on the top and bottom inside surfaces of the housing 8. The engaging protrusions 23 are projected on top and bottom surfaces of front ends of the insertion legs 21. A pair of the projecting portions 24 are projected at a center of the base bar 20 to receive the middle partition 11 of the housing 8 so as to guide the insertion body 2 and prevent oscillation of the insertion legs 21. Further, side frames 25 are connected to the opposite sides of the base bar 20. Between these side walls, there is formed a hooking member 26 for hitching a belt and a fastening member 27 capable of fastening the belt, so that a length of the belt can be adjusted. According to the present embodiment, it is also possible that the elastic members 6 are arranged on the outside surfaces of the side frames 25 similarly to the first embodiment.

When the insertion legs 21 of the insertion body 2 are inserted in the housing 8 of the buckle body 1, as shown in FIG. 24, the engaging protrusions 23 of the insertion legs 21 are engaged with the first engaging portions 14 of the housing 8, and the second engaging protrusion 41 formed at a center of each of the insertion legs 21 is engaged with the second engaging portion 40 of the housing 8 so as to be fixed. In order to release the engagement of the engaged buckle and separate it into the buckle body 1 and the insertion body 2, the insertion legs 21 of the insertion body 2 are pushed to the inside. Consequently, the engagement of the engaging protrusions 23 and the engaging portions 14 and further the engagement of the second engaging protrusion 41 and the second engaging portion 40 is released. Thus, the insertion legs 21 are pulled out from the housing 8, so that the buckle is separated into the buckle body 1 and the insertion body 2.

While particular embodiments of the present invention have been illustrated and described herein, the present invention should not be limited to such illustrations and descriptions. It should be apparent that changes and modifications may be incorporated and embodied as part of the present invention within the scope of the claims.

What is claimed:

1. A buckle with an engagement and disengagement system in which an insertion body is inserted in a buckle body, wherein an elastic member made of a different material from that of the buckle body and the insertion body is disposed on a pressing surface of an operating portion, which deforms elastically by an engagement and disengagement operation.

2. A buckle according to claim 1, wherein said pressing surface of said operating portion is formed on an outside surface of each of a pair of insertion legs, which are provided at opposite sides of said insertion body.

3. A buckle according to claim 2, wherein said pressing surface of said operating portion is formed so as not to be in sliding contact with said buckle body.

4. A buckle according to claim 1, wherein said pressing surface of said operating portion is formed on an outside surface of each of side levers, which are provided at the opposite sides of said buckle body.

5. A buckle according to claim 1, wherein said pressing surface of said operating portion is formed on a pressing plate, which is provided at an upper side of said buckle body.

6. A buckle according to claim 1, wherein said buckle body and said insertion body are molded of thermoplastic resin, and said elastic member is made of any one of natural rubber, synthetic rubber, and thermoplastic elastomer.

7. A buckle according to claim 1, wherein a color of said buckle body and said insertion body is made to be different from a color of said elastic member.

8. A buckle according to claim 1, wherein said elastic member disposed on said pressing surface is projected more than said pressing surface.

9. A buckle according to claim 1, wherein said buckle body or said insertion body and said elastic member are integrally molded by bicolor molding means or insert molding means.

10. A buckle according to claim 1, wherein said elastic member is disposed on a part of a surface of said buckle body.

11. A buckle according to claim 4 or 10, wherein a pattern or a logo mark, of which color is different from the color of said elastic members, is displayed on a part of said elastic members disposed on a surface of said buckle body.

* * * * *